US006581616B1

(12) United States Patent
Venegas, Jr.

(10) Patent No.: US 6,581,616 B1
(45) Date of Patent: Jun. 24, 2003

(54) COVERED CART CORRAL

(76) Inventor: Frank Venegas, Jr., 5682 Lake Ridge Dr., Brighton, MI (US) 48116

( * ) Notice: Subject to any disclaimer, the term of this patent is extended or adjusted under 35 U.S.C. 154(b) by 0 days.

(21) Appl. No.: 09/605,478

(22) Filed: Jun. 28, 2000

(51) Int. Cl.[7] ..... A47F 7/00
(52) U.S. Cl. ..... 135/121; 211/17; 211/189; 256/1
(58) Field of Search ..... 211/17, 189, 22; 256/1, 24, 25; 135/121

(56) References Cited

U.S. PATENT DOCUMENTS

| | | | | |
|---|---|---|---|---|
| 3,561,567 | A | 2/1971 | Bradley | 186/1 |
| 4,236,697 | A | 12/1980 | Savino | 256/1 |
| 4,609,183 | A | 9/1986 | Ulmer | 256/1 |
| 5,201,426 | A | 4/1993 | Cruwell, Jr. | 211/17 |
| 5,279,085 | A | 1/1994 | DiPaolo et al. | 52/169.2 |
| 5,551,578 | A | 9/1996 | McCue et al. | 211/17 |
| 5,862,921 | A | 1/1999 | Venegas, Jr. | 211/17 |

OTHER PUBLICATIONS

Ernie's Shopping Cart Specialties Internet website, 2 pages.
McCue Corporation Internet website, 1 page.

*Primary Examiner*—Robert W. Gibson, Jr.

(74) *Attorney, Agent, or Firm*—Gifford, Krass, Groh, Sprinkle, Anderson & Citkowski, PC

(57) ABSTRACT

A cart corral for receiving shopping carts in a parking lot is designed to support a roof. Four spaced apart vertical posts are defined as a left front corner post, a right front corner, a left rear corner post, and a right rear corner post. Each of the posts has substantially an equal height and an outside diameter. Each of the posts has a lower end designed to contact a support surface and an upper end designed to support the roof. Replaceable polymerized sheathing surrounds each of the posts. The sheathing has an inner diameter equal to or greater than the outer diameter of the posts and extends substantially the entire height of the posts. A first horizontal rail extends between the left rear and right rear corner posts and releasably engages the posts between the upper and lower ends. A second horizontal rail extends between the right rear and right front corner posts and releasably engages the posts between their upper and lower ends. A third horizontal rail extends between the left rear and left front corner posts and releasably engages the posts between their upper and lower ends. Replaceable polymerized sheathing surrounds each of the horizontal rails and has an inner diameter equal to or greater than the outer diameter of the horizontal rails and extends substantially the entire length of the horizontal rails.

6 Claims, 6 Drawing Sheets

FIG-7
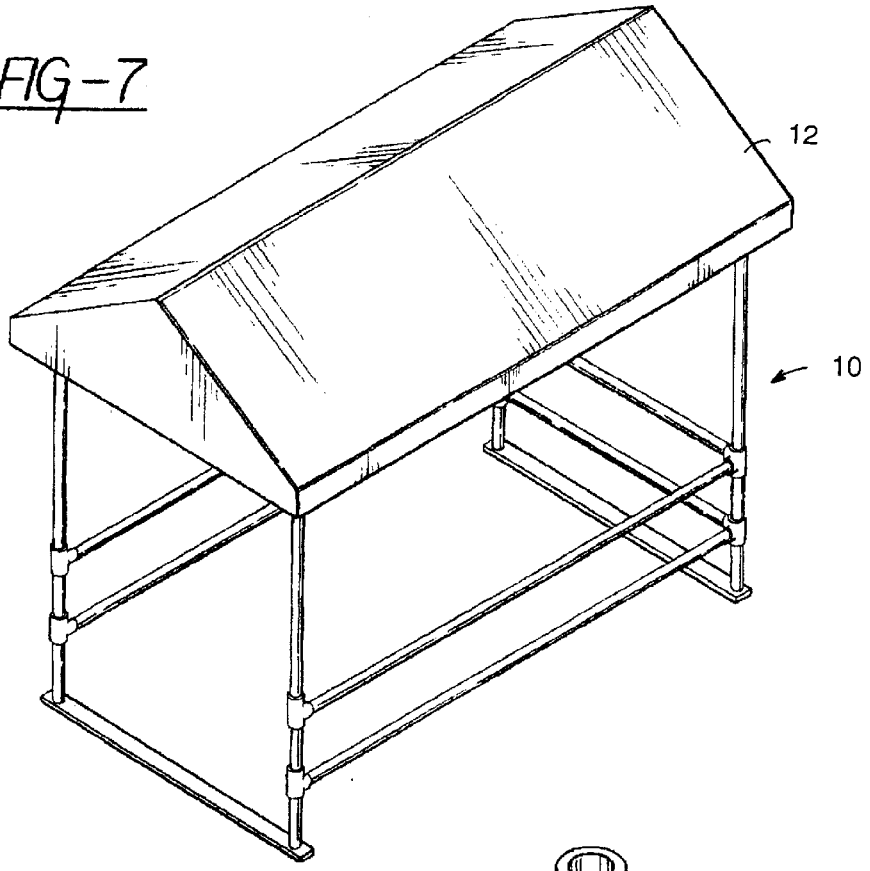
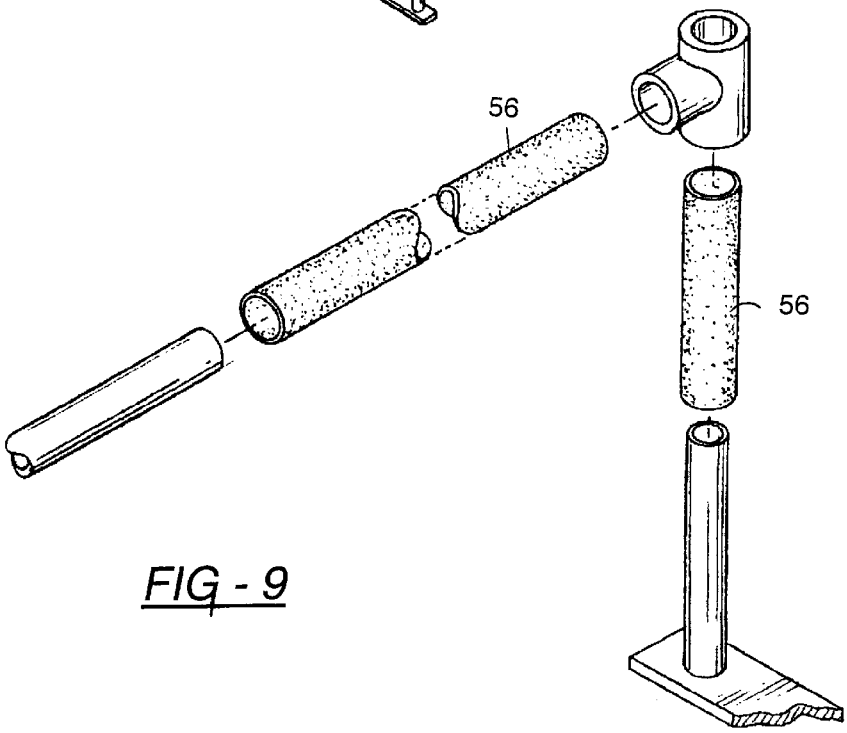
FIG - 9

COVERED CART CORRAL

FIELD OF THE INVENTION

The present invention generally relates to corrals of the type designed to collect shopping carts.

BACKGROUND OF THE INVENTION

Shopping carts are currently provided by numerous retailers for their customers' use. Typically, customers use the carts to collect the merchandise they wish to purchase and, after purchasing the items, roll the cart into the parking lot to their automobile to unload. After unloading, many users do not wish to walk back to the store to return the cart. However, leaving carts in the parking lot presents numerous well known disadvantages. One approach to solving this problem has been for retailers to provide cart corrals at various locations in the parking lot. These cart corrals typically consist of bent metal poles assembled to define a retention area for the shopping carts. A user pushes the shopping cart into the corral where it nests with other shopping carts and is retained until retrieved by store personnel. While currently available cart corrals function well, they have several disadvantages. Most available cart corrals are made from very long pieces of galvanized metal tubing which are bent to a desired shape. Transportation of these large pieces of tubing presents a challenge. Also, most cart corrals are not aesthetically pleasing, as they are available only in the gray color associated with galvanized metal. Some cart corrals are painted to give them a colorful appearance. However, due to constant banging by carts, the paint often becomes chipped and the appearance of the cart corral becomes unacceptable. Carts may also become dirty or wet while retained in a cart corral located in an open parking lot. Some cart corrals include a roof to shelter the carts. However, these covered cart corrals, like uncovered cart corrals, typically include very large members that are bent to shape and may not be disassembled into smaller sizes. Therefore, transportation and setup remain difficult. In light of the above, there is a need for improved cart corrals, especially those with a roof to shelter the carts.

SUMMARY OF THE INVENTION

The present invention provides an improved cart corral to receive shopping carts in a parking lot. The cart corral is designed to support a roof and, in some embodiments, may include the roof as part of the invention. The cart corral includes four spaced apart vertical posts that may be identified as a left front corner post, a right front corner post, a left rear corner post, and a right rear corner post. Each of the posts has a substantially equal height and has an outside diameter. Each of the posts has a lower end designed to contact the support surface and an upper end designed to support the roof. Replaceable polymerized sheathing surrounds each of the posts. The sheathing has an inner diameter equal to or greater than the outer diameter of the posts, and the sheathing extends substantially the entire height of the posts. A first horizontal rail extends between the left rear and right rear corner posts and releasably engages the posts between their upper and lower ends. A second horizontal rail extends between the right rear and right front corner posts and releasably engages the posts between their upper and lower ends. A third horizontal rail extends between the left rear and left front corner posts and releasably engages the posts between their upper and lower ends. Each of the horizontal rails has an outer diameter and a length. Replaceable polymerized sheathing surrounds each of the horizontal rails. The sheathing has an inner diameter equal to or greater than the outer diameter of the horizontal rails and extends substantially the entire length of the horizontal rails.

BRIEF DESCRIPTION OF THE DRAWINGS

FIG. 7 is a perspective view of the cart corral according to the present invention with a roof included;

FIG. 9 is a detailed blow up view of a portion of the present invention showing the inner members and polymerized sheathing;

DETAILED DESCRIPTION OF THE PREFERRED EMBODIMENTS

Figure 1:
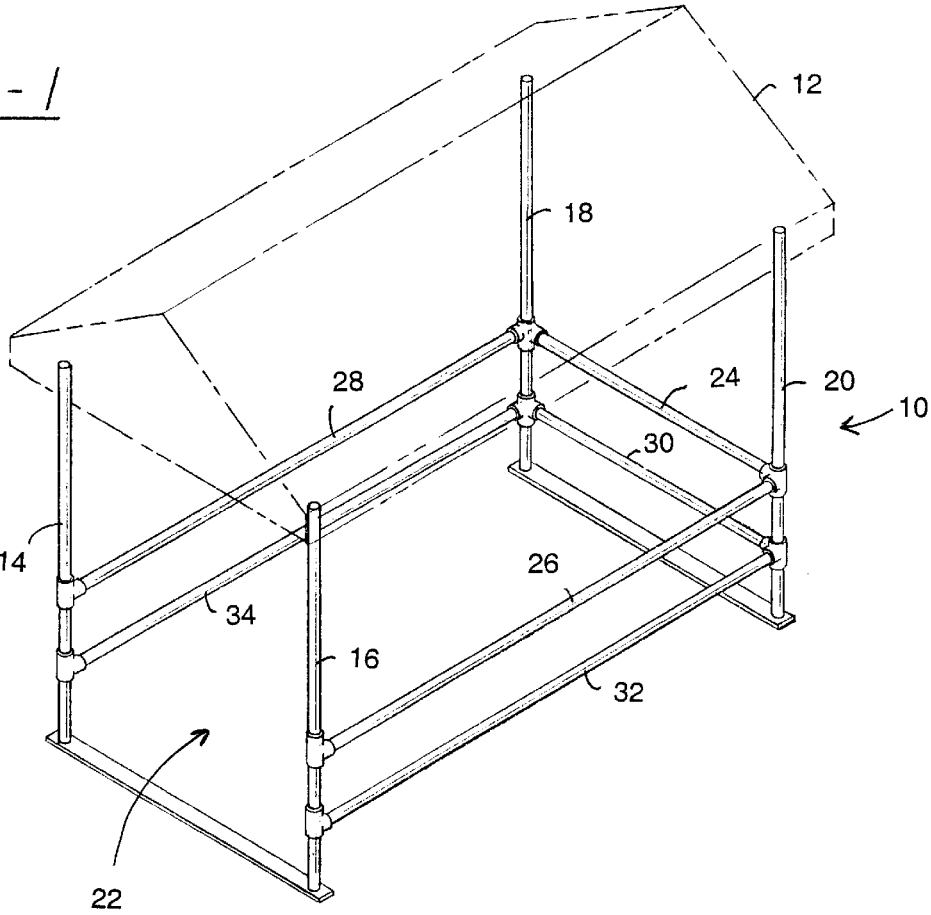
FIG. 1 is a perspective view of a cart corral according to the present invention with a roof shown in broken lines.
Figure 2:
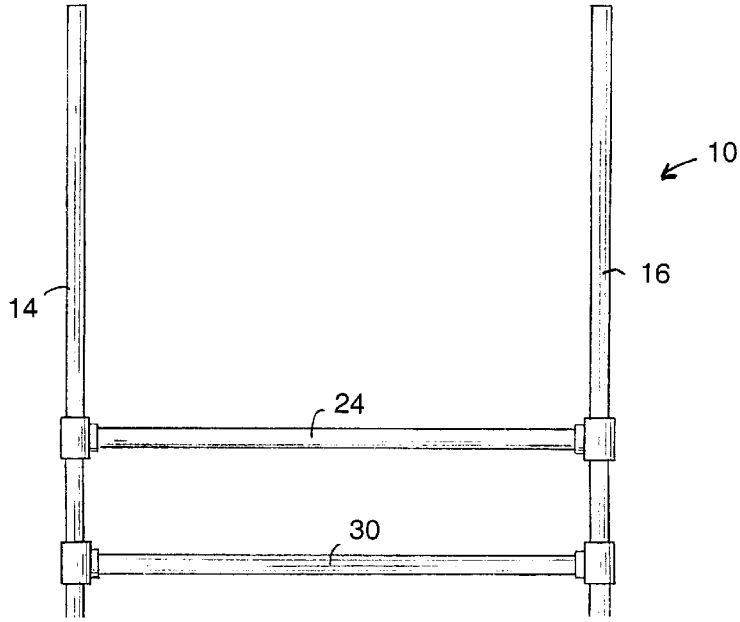
FIG. 2 is a front elevational view of the cart corral of FIG. 1, without the roof.
Figure 3:
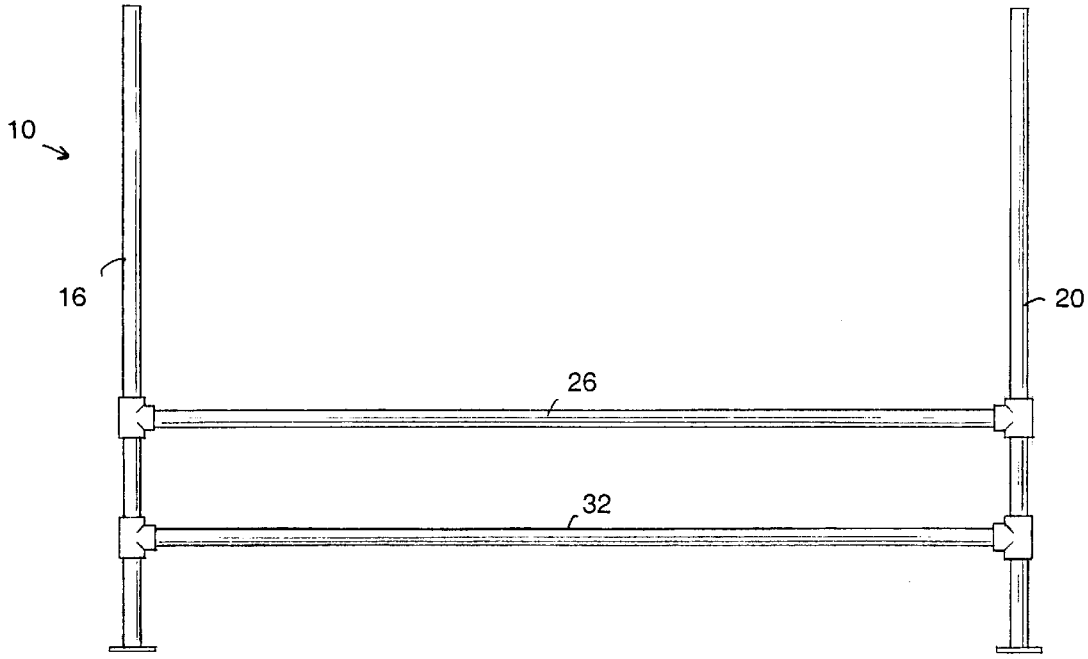
FIG. 3 is a side elevational view of the cart corral of FIG. 1, without a roof, the other side view being identical.
Figure 4:
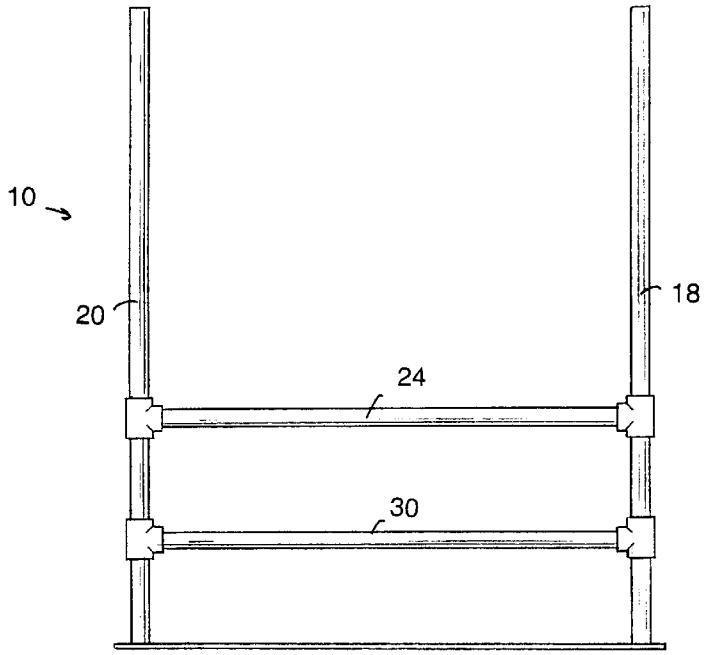
FIG. 4 is a rear perspective view of the cart corral of FIG. 1, without a roof.
Figure 5:
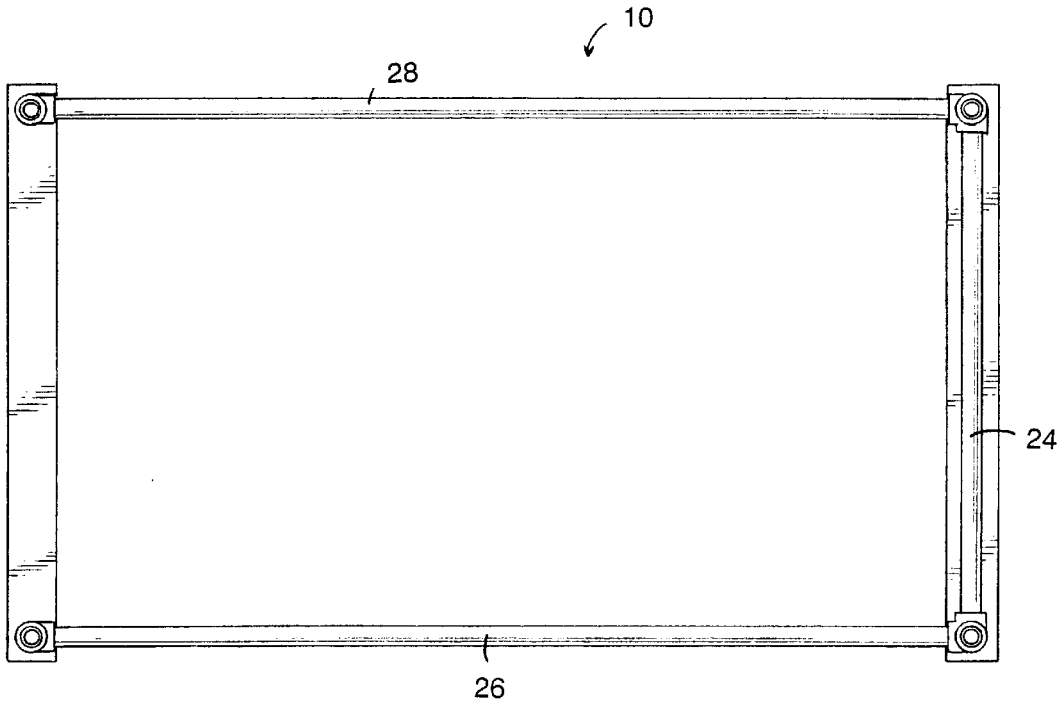
FIG. 5 is a top plan view of the cart corral of FIG. 1, without a roof.
Figure 6:
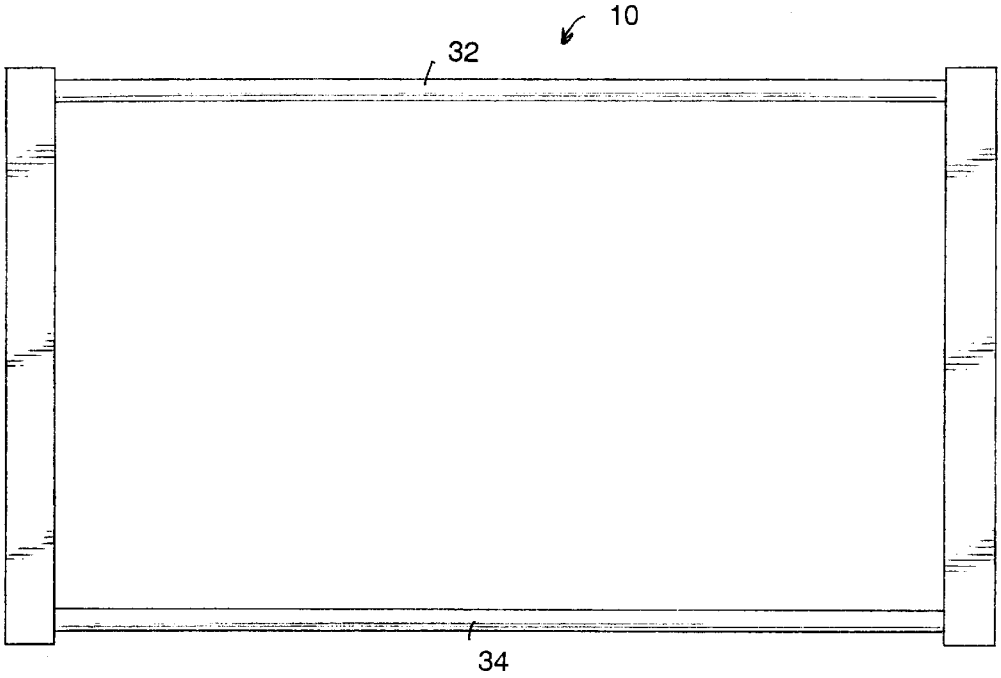
FIG. 6 is a bottom plan view of the cart corral of FIG. 1.

Referring to FIGS. 1–6, a cart corral according to the present invention is generally shown at 10. The cart corral is designed to set on a generally horizontal surface, such as a parking lot, and support a roof 12 which is shown in broken lines. The cart corral includes four spaced apart vertical posts which may be defined as a left front corner post 14, a right front corner post 16, a left rear corner post 18, and a right rear corner post 20. These vertical posts 14–20 define the four corners of the cart corral from the perspective of standing in front of the cart corral and looking toward it. These corner posts 14–20 each have lower ends which rest on a support surface, such as a parking lot, and upper ends which support the roof 12. The vertical posts 14–20 are interconnected by several horizontal rails on three sides so as to provide an enclosed cart retaining area 22 which is open to the front to allow carts to pass in and out of the cart corral 10. As shown, a first horizontal rail 24 extends between the left rear corner post 18 and the right rear corner post 20 and engages these posts between their upper and lower ends. A second horizontal rail 26 extends between the right rear post 20 and the right front post 16. It also engages these posts between their upper and lower ends. A third horizontal rail 28 extends between the left rear corner post 18 and the left front corner post 14 and engages these posts between their upper and lower ends. As shown, the first, second, and third horizontal rails 24–28 are at the same height above the ground and therefore form a railing around three sides of the cart corral 10. In a preferred embodiment of the present invention, one additional horizontal rail is provided on each of the three sides parallel to and spaced below the first set of horizontal rails 24–28. These include a fourth horizontal rail 30 which is parallel to the first horizontal rail 24, a fifth horizontal rail 32 which is parallel to the second horizontal rail 26, and a sixth horizontal rail 34 which is parallel to the third horizontal rail 28. Together, the first through third and fourth through sixth horizontal rails 24–34 define two parallel railings around three sides of the cart corral 10 as best shown in FIG. 1.

As shown in FIG. 7, the cart corral 10 may include a roof 12 as part of the invention. The roof 12 may be of several types known to those of skill in the art. The illustrated roof includes fabric stretched over a frame with the frame interconnected to the upper ends of the four corner posts 14–20.

Figure 8:
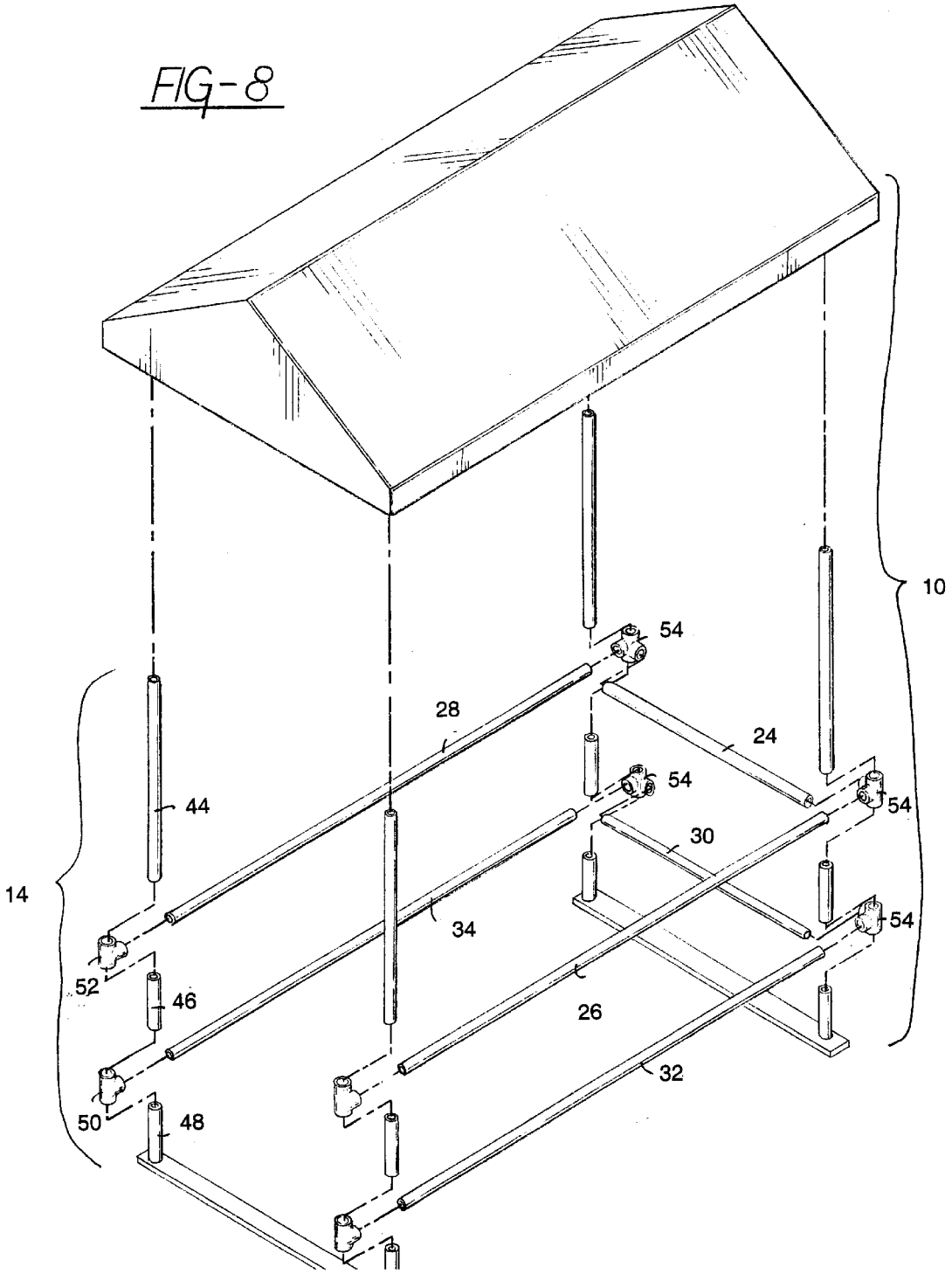
FIG. 8 is an exploded view of the covered cart corral of FIG. 7.
Figure 10:
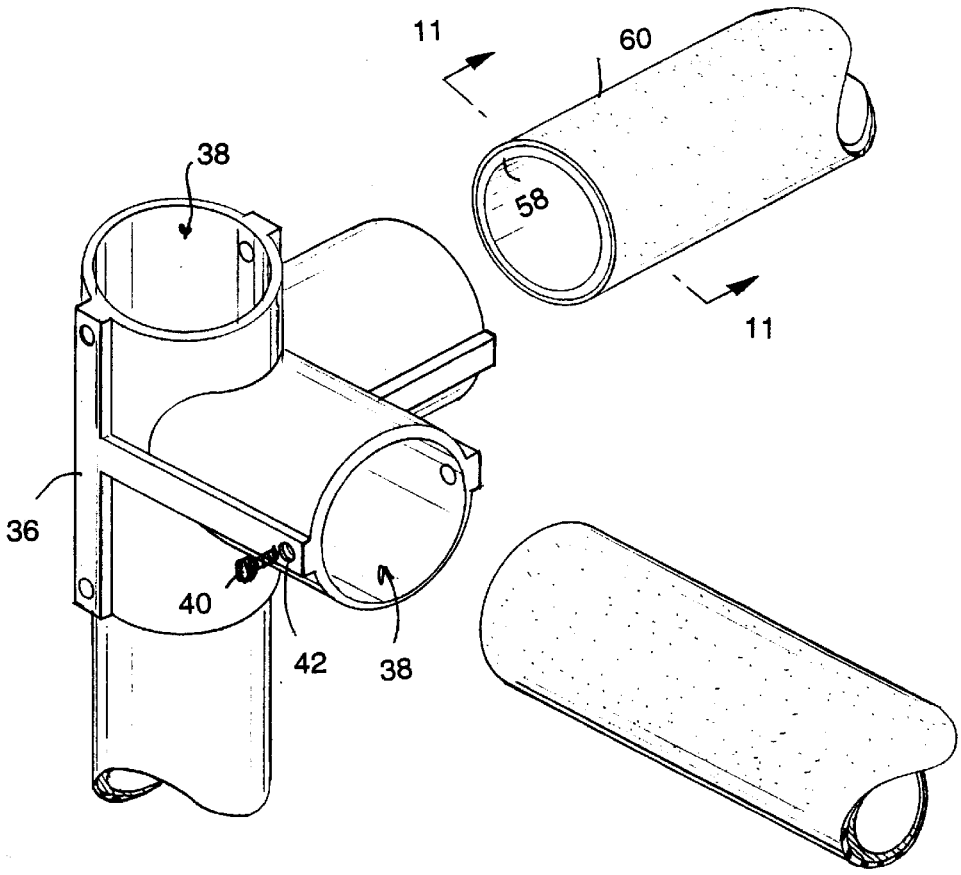
FIG. 10 is a detailed perspective view of a fitting for use with the present invention along with portions of tubular members that connect therewith.

As best shown in FIG. 8, the cart corral 10 is disassemblable into smaller component pieces. For example, each of the horizontal rails 24–34 releasably engages the corner posts 14–20 to which it connects. This is done using fittings, a detail of which is shown in FIG. 10. The fitting 36 is a multi-angle fitting designed to accept multiple tubular members and rigidly interconnect them. The illustrated fitting is preferably a Hollaender slip-on structural fitting. Tubular members, such as the horizontal rails and corner posts, slip into openings 38 in the fitting 36 where they are secured by set screws 40 which thread through threaded openings 42 in the sides of the fitting 36.

As shown in FIG. 8, multiple ones of these Hollaender fittings are used to interconnect the tubular members which make up the cart corral 10. Also, the vertical posts 14–16 are preferably formed from multiple component pieces to reduce the overall size of each individual component. For example, the left front corner post 14 is made up of an upper portion 44, a mid-portion 46, and a lower portion 48. These portions 44–48 are interconnected by T-shaped fittings 50 and 52. As shown, each T-shaped fitting has an upper opening, a lower opening, and a side opening. In assembling the cart corral 10, the left front corner post 14 is formed by inserting the upper end of lower portion 48 of the post 14 into the lower opening of the lower T fitting 50. The lower end of the mid-portion 46 is inserted into the upper opening of the lower T fitting 50 and the upper end of the mid-portion 46 is inserted into the lower opening in the upper T fitting 52. Finally, the lower end of the upper portion 44 is inserted into the upper opening in the upper T fitting 52. Set screws in each of the fittings are secured to interlock the portions 44–48 so as to create a rigid vertical post 14. The third horizontal rail 28 and sixth horizontal rail 34 interconnect with the left front corner post 14 using these T fittings 50 and 52. That is, one end of the sixth horizontal rail 34 inserts into the side opening in the lower T fitting 50 and one end of the third horizontal rail 28 fits into the side opening of the upper T fitting 52. Once again, set screws are tightened to interlock the various members. In this way, each of the portions of the posts and the horizontal rails are releasably engaged with one another to allow for easy assembly and disassembly. Similar considerations apply to the rear corner posts 18 and 20, wherein Hollaender fittings 54 with four openings each are used. Each of these fittings 54 has an upper opening, a lower opening, and two side openings, with the side openings being perpendicular to one another. The fitting shown in FIG. 10 has the same design.

While the corner posts are shown as being assembled from three portions in FIG. 8, the posts may instead be single units with the fittings slid along the length of the posts until in the proper position. Also, throughout the drawings, the posts and rails are illustrated as having identical diameters. However, as will be clear to those of skill in the art, large and small diameter posts and rails may be mixed depending on the application and desired appearance.

Figure 11:
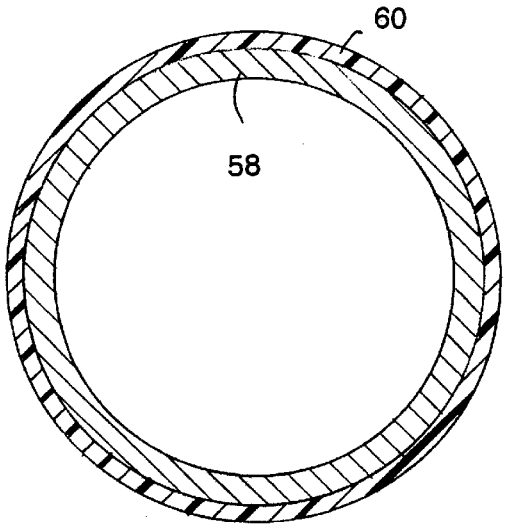
FIG. 11 is a cross sectional view of a tube and polymerized sheathing, taken along lines 11—11 in FIG. 10.

Referring now to FIG. 9, a detail of a lower portion of a vertical post and one end of a horizontal rail is shown along with a T-shaped fitting. This figure illustrates an important aspect of the present invention. Namely, each of the vertical posts and horizontal rails include polymerized sheathing which covers the tubes and rails. Preferably, the tubes and rails are metal such as steel to give structure and rigidity to the cart corral 10. The polymerized sheathing 56 has an inner diameter equal to or greater than the outer diameter of the metal tubing and extends substantially the entire length of the tubing. FIG. 11 shows a cross section of an assembled metal tube 58 with polymerized sheathing 60 surrounding it. As shown in FIG. 10, the sheathing 60 is coextensive with the metal tube 58 and therefore enters the fitting 36 when the cart corral is assembled. The set screw engages the side of the combined sheathing and metal tube and may penetrate the plastic sheathing when tightened.

The use of polymerized sheathing surrounding the posts and rails offers numerous advantages. The polymerized sheathing is available in many colors, and therefore a store owner may choose colors which match or complement the store colors. This would include using multiple colors on a single cart corral so as to give a pleasing appearance. Because the polymerized sheathing may be removed and replaced from the metal tubes, the colors of the cart corral may be changed if store ownership or colors change. Also, if the polymerized sheathing becomes damaged, it may be changed to improve the aesthetic appearance. The polymerized sheathing also is tough and serves to protect the metal tubing underneath. The polymerized sheathing withstands scrapes and blows from carts and does not chip as would paint. Therefore, the polymerized sheathing allows the cart corral to maintain a pleasing aesthetic appearance for a long period of use. Polymerized sheathing also prevents moisture and contaminants from reaching the metal tube underneath and therefore reduces the likelihood of discoloration and rust. And, because the polymerized sheathing covers the metal tubing, the appearance of the metal tubing itself is not important. Therefore, it is not critical to use high grade tubing or tubing with a consistent appearance.

As will be clear to those of skill in the art, the present invention may be modified in various ways without departing from the scope or teaching of the present invention. Therefore, the specification and figures should be interpreted broadly. It is the following claims, including all equivalents, which define the scope of the invention.

What is claimed is:

1. A covered cart corral for receiving shopping carts in a parking lot, said cart corral comprising:

four spaced apart vertical posts comprising a left front corner post, a right front corner post, a left rear corner post, and a right rear corner post, each of said posts having a substantially equal height and an outside diameter, each of said posts having a lower end configured to contact a support surface and an upper end configured to support a roof;

replaceable polymerized sheathing surrounding each of said posts, said sheathing having an inner diameter equal to or greater than the outer diameter of said posts, said sheathing extending substantially the entire height of said posts;

a first horizontal rail extending between said left rear and said right rear corner posts and releasably engaged to said posts between said upper and lower ends;

a second horizontal rail extending between said right rear and said right front corner posts and releasably engaged to said posts between said upper and said lower ends;

a third horizontal rail extending between said left rear and said left front corner posts and releasably engaged to said posts between said upper and said lower ends;

each of said horizontal rails having an outer diameter and a length;

replaceable polymerized sheathing surrounding each of said horizontal rails, said sheathing having an inner diameter equal to or greater than the outer diameter of said horizontal rails and extending substantially the entire length of said horizontal rails; and a roof extending between said vertical posts so as to cover an area defined between said posts, said roof releasably interconnected with the upper end of each of said posts.

2. The cart corral according to claim 1, wherein first, second and third horizontal rails are disposed at the same height.

3. The cart corral according to claim 1, wherein said second and third horizontal rails are each perpendicular to said first horizontal rail.

4. The cart corral according to claim 1, further comprising fittings serving to releasably engage said posts and said rails.

5. The cart corral according to claim 1, further comprising:

a fourth horizontal rail extending between said left rear and said right rear corner posts and releasably engaged to said posts between said upper and lower ends;

a fifth horizontal rail extending between said right rear and said right front corner posts and releasably engaged to said posts between said upper and said lower ends;

a sixth horizontal rail extending between said left rear and said left front corner posts and releasably engaged to said posts between said upper and said lower ends; and wherein each of said fourth, fifth, and sixth horizontal rails has an outer diameter and a length, said corral further comprising:

replaceable polymerized sheathing surrounding each of said fourth, fifth, and sixth horizontal rails, said sheathing having an inner diameter equal to or greater than the outer diameter of said horizontal rails and extending substantially the entire length of said horizontal rails.

6. The cart corral according to claim 5, wherein said fourth horizontal rail is parallel to and spaced from said first horizontal rail, said fifth horizontal rail is parallel to and spaced from said second horizontal rail, and said sixth horizontal rail is parallel to and spaced from said third horizontal rail.

* * * * *